US005429183A

United States Patent [19]

Hisamori et al.

[11] Patent Number: 5,429,183

[45] Date of Patent: Jul. 4, 1995

[54] PLATE-TYPE HEAT EXCHANGER AND METHOD OF PRODUCING THE SAME

[75] Inventors: Youichi Hisamori, Hyogo; Mitunori Kurachi, Wakayama; Masaaki Taniguchi, Wakayama; Tutomu Noma, Wakayama; Masao Kohashi, Tokyo; Yoshihiro Sumida, Hyogo, all of Japan

[73] Assignee: Mitsubishi Denki Kabushiki Kaisha, Tokyo, Japan

[21] Appl. No.: 75,873

[22] Filed: Jun. 14, 1993

[30] Foreign Application Priority Data

Jun. 17, 1992 [JP] Japan ..... 4-157664
Mar. 16, 1993 [JP] Japan ..... 5-055657

[51] Int. Cl.[6] ..... F28F 19/00

[52] U.S. Cl. ..... 165/134.1; 165/167; 165/905; 285/173

[58] Field of Search ..... 165/166, 167, 905, 134.1; 285/158, 173, 329

[56] References Cited

U.S. PATENT DOCUMENTS 1,979,961 11/1934 Dantsizen ..... 285/173 X
3,953,311 4/1976 Wasson ..... 204/197
4,693,501 9/1987 Logsdon, jr. et al. ..... 285/173
5,169,180 12/1942 Villoni et al. ..... 285/329 X

FOREIGN PATENT DOCUMENTS 0139500 5/1985 European Pat. Off. .
1597659 6/1970 Germany ..... 165/166
50-27020 8/1975 Japan .
93291 5/1985 Japan ..... 165/166
60-189780 12/1985 Japan .
2-306097 12/1990 Japan .
2019550 10/1979 United Kingdom ..... 165/167
1591123 6/1981 United Kingdom .

*Primary Examiner*—John Rivell
*Assistant Examiner*—L. R. Leo
*Attorney, Agent, or Firm*—Oblon, Spivak, McClelland, Maier & Neustadt

[57] ABSTRACT

To eliminate a fear of electrolytic corrosion even in the case where a heat exchanger to be connected to the outside of the plate-type heat exchanger has a copper piping, and to prevent any damage from being given to the brazed portions of the plate-type heat exchanger at the time of joining pipes and to prevent faults from being generated in joined portions. An intermediate pipe made of a material in which the value of polarization potential becomes lower than that generated between a body of the plate-type heat exchanger and the copper piping is interposed between the plate-type heat exchanger body and the copper piping. Further, the plate-type heat exchanger body is disposed in a position out of a vertical line of a joined portion between the copper piping and the intermediate pipe. Further, a joint constituted by an intermediate pipe and a copper pipe joined in advance through brazing or welding at a temperature higher than a temperature of brazing of the plate-type heat exchanger body is brazed at the same time of brazing of the plate-type heat exchanger body under the condition that the joint is arranged so that the intermediate pipe side of the joint is joined with the end plate of the heat exchanger body.

3 Claims, 7 Drawing Sheets

PLATE-TYPE HEAT EXCHANGER AND METHOD OF PRODUCING THE SAME

BACKGROUND OF THE INVENTION

The present invention relates to a plate-type heat exchanger and a joint structure thereof, in which an aluminum group material is used and junction is made by use of a plate material with its opposite surfaces clad with an aluminum material, and for use in a cooler/-heater heat pump, an oil cooler, etc.

FIG. 7 shows a conventional plate-type heat exchanger, for example, as disclosed in Japanese Utility Model Publication No. Sho-50-27020, and FIG. 8 is a partial section of FIG. 7. In the drawings, the reference numeral 1 designates a plate; 2, a groove to which a packing is to be applied; 3, a first fluid inlet; 4, a first fluid outlet; 5, a second fluid inlet; and 6, a second fluid outlet. In FIG. 8, the reference numeral 7 designates a packing. The plates 1 in each of which the packing 7 is put in the groove 2 are stacked on one another and fixed by bolts and nuts (not shown) so as to form each tightly closed first and second fluid passages. "A" designates a first fluid and "B" designates a second fluid. Thus, the plates 1 having their grooves 2 with the packings 7 are laminated successively one on one so the first and second fluid communication passages are formed alternately.

Next, a prior art relating to a joint structure of such a plate-type heat exchanger will be described. FIG. 9 is a perspective view showing the state of constituent parts, before joining, of a conventional plate-type heat exchanger (heat sink), for example, as disclosed in Japanese Patent Application No. Hei-1-124154, and FIG. 10 is a perspective view showing the state in which the junction of the plate-type heat exchanger of FIG. 9 has been completed. In the drawings, the reference numeral 31 designates an upper plate having holes **32*a* and 31*b* to which inlet and outlet pipes for a heat exchange fluid such as a refrigerant, that is, a cooling fluid; 31, a lower plate; 33, an intermediate plate made of a brazing sheet having a passage 33*a* through which the cooling fluid flows and having opposite surfaces clad with a brazing material; 34, an inlet pipe which is made of an aluminum material and through which the cooling fluid flows in; and 35, an outlet pipe which is made of an aluminum material and through which the cooling water flows out. These parts are assembled as shown in FIG. 10 and a brazing material for aluminum is set to the inlet pipe 34 and the outlet pipe 35** so that the whole of the plate-type heat exchanger is brazed at aluminum brazing temperature.

Next, operation will be described. First, with respect to FIG. 7, the first fluid A flows from the first fluid inlet 3 to the first fluid outlet 4, and the second fluid B flows from the second fluid inlet 5 to the second fluid outlet 6. The first and second fluids A and B flow, in opposition to each other, respectively through the first and second fluid communication passages tightly sealed by the plates 1 and the grooves 2 with packings 7, and perform heat exchange therebetween through the plates 1.

Next, the operation of FIG. 9 and the method of producing the joint portion will be described. In the conventional plate-type heat exchanger, an a apparatus such as an electronic apparatus (not shown) which may generate heat is fixed on the lower plate 32 in a contacting relation, and an aluminum pipe is connected to the inlet pipe 34 through torch brazing (not shown), so that a cooling fluid is made to flow in through the inlet pipe 34. The cooling fluid flows to the outlet pipe 35 and performs heat exchange between the cooling fluid and the apparatus which may generate heat through the lower plate 32 to thereby cool the apparatus. The cooling fluid which has been warmed through the heat exchange flows out from the outlet pipe 35. The cooling fluid passes through an aluminum pipe connected to the outlet pipe 35 similarly to the inlet pipe 34, then cooled in the outside of the heat exchanger, and then flows into the inlet pipe 34 again.

Having such a configuration, the conventional plate-type is not stable in the state of air tightness and has a possibility that may occur or substance to be treated may be polluted in accordance with the quality of the packings. The conventional heat exchanger has further problems in that the cost of formation of metal molds for plates is high, design change cannot be made easily, etc.

Further, such a conventional plate-type heat exchanger producing method in which air tightness is provided by brazing joining as described above has problems in that it is necessary to join the aluminum pipes with the fluid outlet and inlet 34 and 35 by brazing or welding after assembling with aluminum brazing so that the brazed portion of the plate-type heat exchanger may be damaged or the joining work at the joint portions between the aluminum pipes and the fluid outlet and inlet portions is troublesome because of a narrow space at the joint portions to thereby make it possible to easily generate defective portions at the joint portions.

In the case where a heat exchanger (not shown) connected to the outside of the plate-type heat exchanger has a copper piping 39, the joining between an aluminum pipe and a copper pipe is difficult, and conventionally, as shown in FIG. 11, therefore, an AC joint 38 composed of a copper pipe 36 and an aluminum pipe 37 which are joined with each other through projection welding is brazed at its aluminum side 37 to the plate type heat exchanger, and the copper pipe 39 is joined to the AC joint 38 at the copper side 36 thereof. Accordingly, in addition to the above-mentioned problems, there has been a problem that copper and aluminum are in direct contact with each other to thereby generate electrolytic corrosion because of a large electric potential between the copper and aluminum.

SUMMARY OF THE INVENTION

The present invention has been attained to solve such problems as mentioned above and an object thereof is to provide a plate type heat exchanger which is simple in configuration, which is high in strength, which does not need any mold for exclusive use, and which is large in the number of degrees of freedom. Another object of the present invention is to provide a plate type heat exchanger in which even in the case where a heat exchanger connected to the outside of the plate-type heat exchanger has a copper piping, there is no possibility of electrolytic corrosion and it is possible to prevent damage from being given to brazed portions of the plate type heat exchanger or prevent defective portions from being generated in the joint portions when pipes are joined.

The plate-type heat exchanger according to the present invention is constituted by end plates having first and second fluid inlets respectively, intermediate plates having a through hole and a fluid communication passage respectively, and a heat exchange plate having through holes and being interposed between the intermediate plates so as to perform heat exchange between the first and second fluids, said end plates, the intermediate plates, and the heat exchange plate being stacked on one another so as to be integrated with each other.

On the other hand, the method of producing a plate-type heat exchanger comprises the steps of disposing a joint constituted by a copper pipe and a stainless pipe being joined in advance with the copper pipe by brazing with a brazing material which performs brazing at a temperature higher than the aluminum brazing temperature or by welding so that the stainless pipe side is joined between the end plates through brazing at the same time of the brazing of the plate-type heat exchanger.

In the thus configured plate-type heat exchanger, the first and second fluids are led, in opposition to each other, to the fluid communication through holes of the respective intermediate plates so as to perform heat exchange therebetween through the heat exchange plate.

On the other hand, in the method of producing a plate-type heat exchanger according the present invention, the pipes each constituted by copper and stainless steel pipes joined in advance are integrally joined simultaneously with the brazing of the plate type heat exchanger so that no damage is given to the brazed portions of the plate type heat exchanger, defects at the joint portions of the outlet and inlet pipes can be reduced, and electrolytic corrosion is hardly generated because the electric potential between copper and stainless steel is smaller than that in the conventional case between aluminum and copper.

DETAILED DESCRIPTION OF PREFERRED EMBODIMENTS

Embodiment 1

Figure 1:
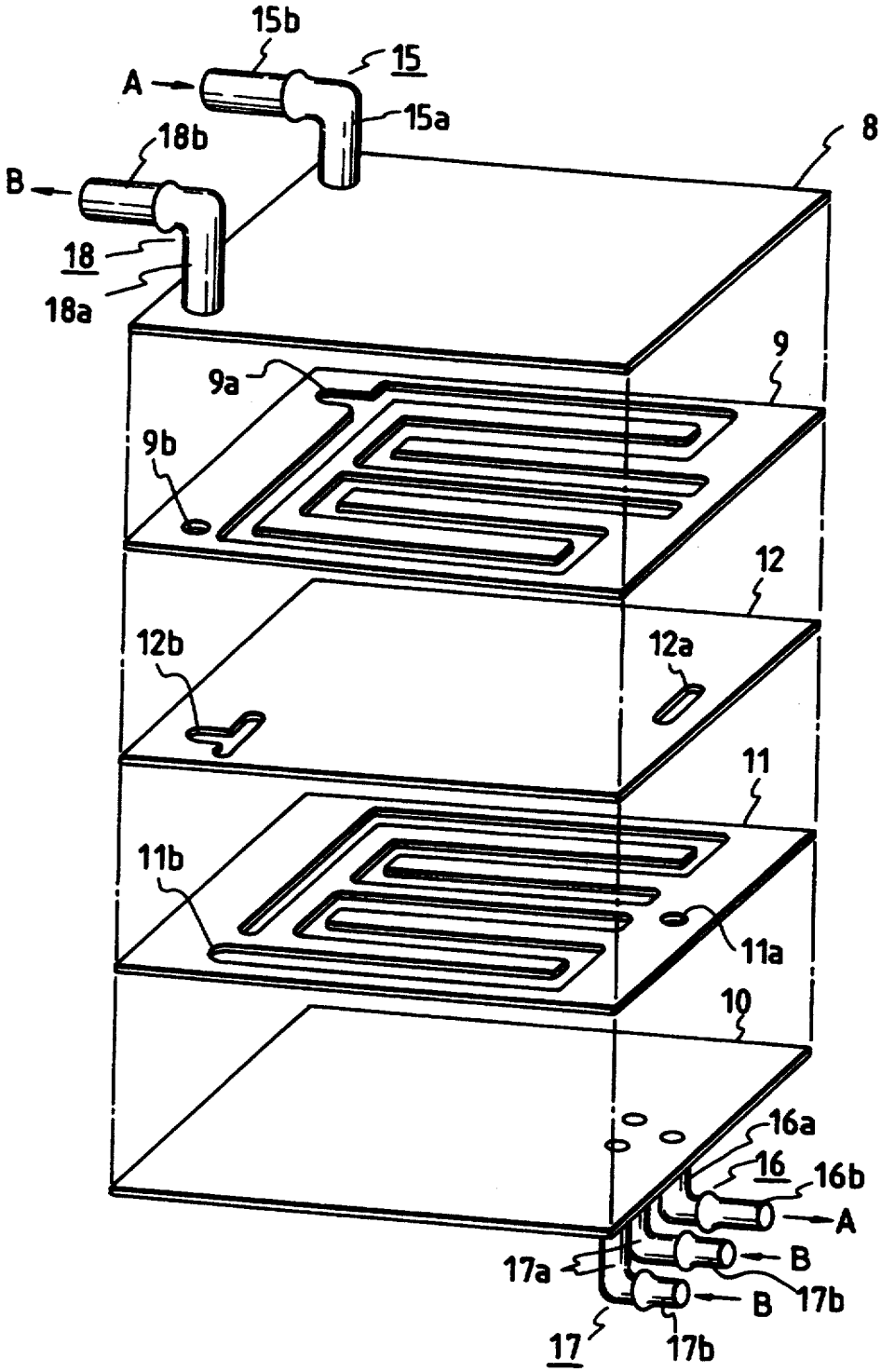
FIG. 1 is an exploded perspective view showing a plate type heat exchanger of a stack of 5 plates according to Embodiment 1 of the present invention.

Referring to the drawings, an embodiment of the present invention will be described hereunder. FIG. 1 is an exploded perspective view of the plate-type heat exchanger of a stack of 5 plates, showing Embodiment 1 of the present invention. In the drawing, the reference numeral 15 designates a fluid inlet pipe for a heat exchange fluid A of high pressure (30 to 45 kgf/cm$^2$) on the condensation side. The fluid inlet pipe 15 is formed in a separate step in advance by joining a pipe 15*a* of a stainless steel material with a pipe 15*b* of a copper material through silver-alloy brazing. Similarly to this, the reference numeral 16 designates a fluid outlet pipe for the heat exchange fluid A of high pressure on the condensation side, the fluid outlet pipe 16 being formed in a separate step in advance by joining a pipe 16*a* of a stainless steel material with a pipe 16*b* of a copper material through silver-alloy brazing. The reference numeral 17 designates fluid inlet pipes for a heat exchange fluid B of low pressure on the evaporation side, each of the fluid inlet pipes 17 being formed in a separate step in advance by joining a pipe 17*a* of a stainless steel material with a pipe 17*b* of a copper material through silver-alloy brazing. Similarly to this, the reference numeral 18 designates a fluid outlet pipe for the heat exchange fluid B of low pressure on the evaporation side, the fluid outlet pipe 18 being formed in a separate step in advance by joining a pipe 18*a* of a stainless steel material with a pipe 18*b* of a copper material through silver-alloy brazing. These joints are brazed by aluminum brazing at their stainless-steel sides to the end plate 8 or 10 made of an aluminum material.

The reference numeral 8 designates a first end plate which is, for example, an aluminum plate. The reference numeral 9 designates a first intermediate plate which is, for example, a brazing sheet with its opposite surfaces coated with a brazing material. The reference numeral 9*a* designates a first heat exchange fluid communication passage through hole formed in the first intermediate plate continuously in a range including a first fluid inlet 3, the passage 9*a* being formed so as to meander from the outside to the inside in order to make the heat exchange area wider. The reference numeral 9*b* designates a first through hole which communicates with a second fluid outlet 6.

The reference numeral 10 designates a second end plate which is, for example, an aluminum plate, 11 designates a second intermediate plate which is, for example, a brazing sheet with its opposite surfaces coated with a brazing material, 11*a* designates a second through hole which communicates with the second fluid outlet 4, and 11*b* designates a second heat exchange fluid communication passage through hole formed in the second intermediate plate continuously in a range including a second heat exchange fluid inlet 5, the second heat exchange fluid communication passage through hole 11*b* being arranged to be in opposition to the first heat exchange fluid communication passage through hole 9*a* to thereby form a passage.

The reference numeral 12 designates a heat exchange plate which is, for example, an aluminum plate, disposed between the first and second intermediate plates 9 and 11 so as to perform heat exchange between the first and second heat exchange fluids A and B, 12*a* designates a third through hole formed in the heat exchange plate 12 so as to make the first heat exchange fluid communication passage through hole 9a communicate with the second through hole 11a, and 12b designates a fourth through hole formed so as to make the second heat exchange fluid communication passage through hole 11b communicate with the first through hole 9b.

Figure 2:
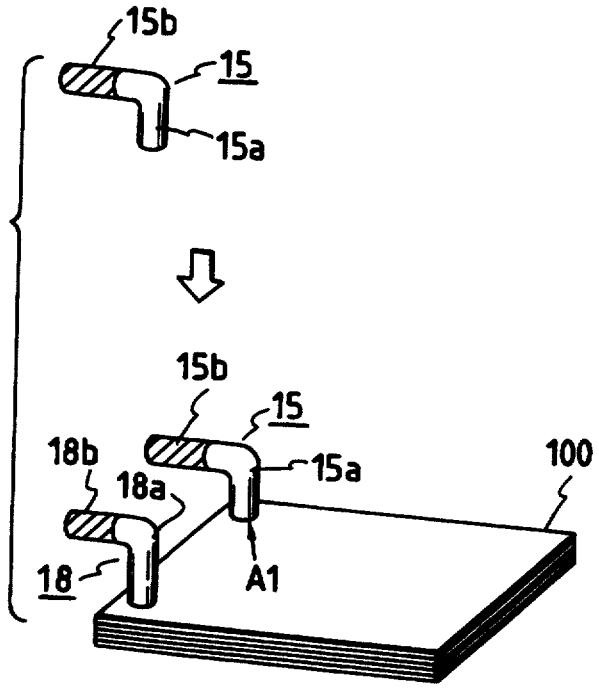
FIG. 2 is a view showing a method of manufacturing the plate type heat exchanger of a stack of 5 plates according to Embodiment 1 of the present invention.
Figure 9:
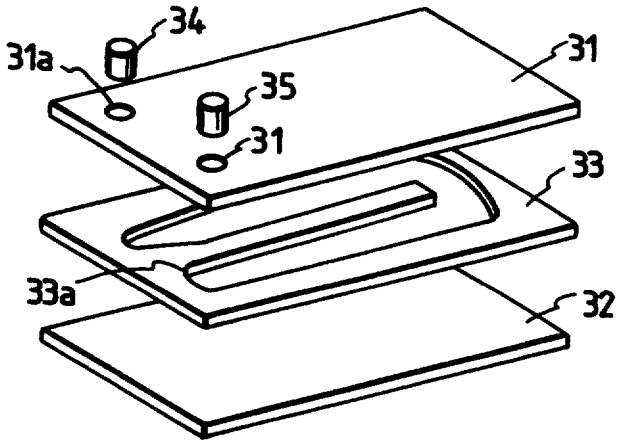
FIG. 9 (PRIOR ART)
FIG. 9 is an exploded perspective view showing a conventional plate type heat exchanger of a stack of 3 plates.
Figure 10:
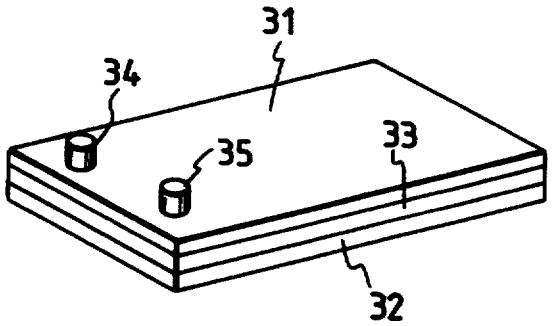
FIG. 10 (PRIOR ART)
FIG. 10 is an assembled perspective view showing the conventional plate type heat exchanger of a stack of 3 plates.

The above-mentioned various through holes are worked by using a laser cutter or a turret punching press. Then, as shown in FIG. 2, pipes 15a, 16a, 17a, and 18a made of a stainless steel material and pipes 15b, 16b, 17b and 18b made of a copper material are joined in advance with each other respectively by silver-alloy brazing ($BA_{g-7}$) at about 700° C. For example, when brazing is performed by using anti-corrosion flux, flux is spray- applied uniformly onto surfaces to be joined (opposite surfaces of each of the intermediate plates 9 and 11). Then the first end plate 8, the first intermediate plate 9, the heat exchange plate 12, the second intermediate plate 11, and the second end plate 10 are successively laminated in order; an aluminum brazing material (ring brazing BA4045 or BA4343) is set to the junction portions between the respective stainless steel sides of the first heat exchange fluid inlet pipe 15, the first heat exchange fluid outlet pipe 16, the second heat exchange fluid inlet pipes 17 and the second heat exchange fluid outlet pipe 18 and the respective aluminum end plates 8 and 10; flux is applied to the circumference of the aluminum brazing material. The thus prepared not-yet joined structure is put into a brazing furnace and heated to 600° C. which is a temperature for aluminum brazing so that the structure is integrally fixed by brazing at the same time. At this time, the junction between stainless steel and copper which has been brazed by silver-alloy brazing in advance is not melted again and no bad influence is given to the brazed portions of the junctions because the silver-alloy brazing temperature is 700° C. which is higher than the aluminum brazing temperature. In the case of using other members, the members are integrally fixed by brazing or through an adhesive agent, and as the heat exchange plate body, a plate having thermally good conductivity such as an aluminum plate or the like is used.

The operation of heat exchange will be described.

In this embodiment, the first heat exchange fluid A is, for example, freon refrigerant. This first heat exchange fluid A is led to the first heat exchange fluid communication passage through hole 9a through the inlet 15 having a brazed stainless steel-copper junction. At the through hole 9a, the first heat exchange fluid A divisionally flows into two directions so as to meander from the outside toward inside and then the two flows join together at the third through hole 12a. Then, the joined flow reaches the first fluid outlet 16 through the second through hole 11a and flows out of the stainless-steel—copper pipe brazed to the outlet 16. The second heat exchange fluid B is also freon refrigerant which is lower in temperature than the first heat exchange fluid A, in this embodiment. The second heat exchange fluid B is led to the second heat exchange fluid communication passage through holes 11b from the second heat exchange fluid inlets 17 at two places. A stainless-steel—copper pipe is joined by brazing to each of the second heat exchange fluid inlets 17 so that the heat exchange fluid B flows into each inlet 17 through the stainless-steel—copper pipe. At this time, each second heat exchange fluid communication passage through hole 11b has a passage in opposition to the first heat exchange fluid communication passage through hole 9a so that the second heat exchange fluid B performs heat exchange here with the first heat exchange fluid A through the heat exchange plate 12. After heat exchange, the second heat exchange fluids B join each other at the fourth through hole 12b. The thus joined second heat exchange fluid B reaches the second heat exchange outlet 18 through the first through hole 9b, flows into another heat exchanger through the stainless-steel—copper pipe brazed to the second heat exchange outlet 18, and then discharged into the inlet 15 after heat exchange.

The first and second heat exchange fluid communication passage through holes 9a and 11b are strongly piled up through brazing or adhesive on the surfaces of the first end plate 8, the heat exchange plate 12, and the second end plate 10 to thereby form tightly sealed fluid passages.

Further, each joint is made of a stainless steel material so that electrolytic corrosion hardly occurs because the electric potential between copper and stainless steel is smaller than that between copper and aluminum in the conventional AC joint.

Embodiment 2

Figure 3:
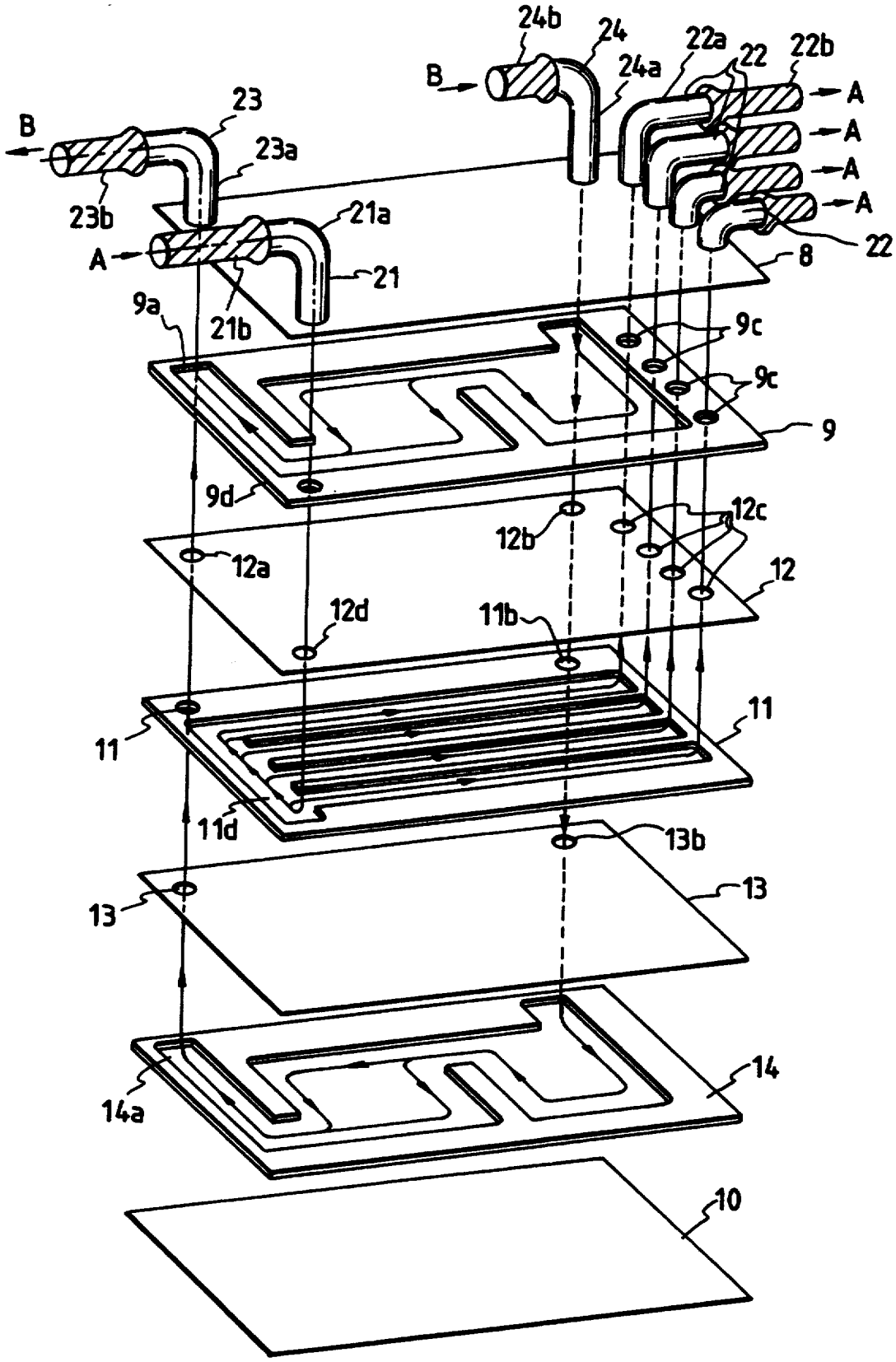
FIG. 3 is an exploded perspective view showing a plate type heat exchanger of a stack of 7 plates according to Embodiment 2 of the present invention.

FIG. 3 is a perspective view showing the state of the constituent parts before joining of a plate-type heat exchanger of a stack of 7 plates, which is obtained by further developing the above-mentioned plate-type heat exchanger of a stack of 5 plates. In the drawing, the reference numeral 21 designates a fluid inlet pipe for a first heat exchange fluid A. The fluid inlet pipe 21 is formed in a separate step in advance by joining a pipe 21a of a stainless steel material with a pipe 21b of a copper material through silver-alloy brazing. Similarly to this, the reference numeral 22 designates fluid outlet pipes for the first heat exchange fluid A, each of the fluid outlet pipes 22 being formed in a separate step in advance by joining a pipe 22a of a stainless steel material with a pipe 22b of a copper material through silver-alloy brazing. The reference numeral 23 designates a fluid inlet pipe for a second heat exchange fluid B, the fluid inlet pipe 23 being formed in a separate step in advance by joining a pipe 23a of a stainless steel material with a pipe 23b of a copper material through silver-alloy brazing. Similarly to this, the reference numeral 24 designates a fluid outlet pipe for the second heat exchange fluid B, the fluid outlet pipe 24 being formed by joining a pipe 24a of a stainless steel material with a pipe 24b of a copper material through silver-alloy brazing. These joints are brazed at their stainless-steel sides to the end plate 8 or 10 made of an aluminum material.

The reference numeral 8 designates a first end plate which is, for example, an aluminum plate. The reference numeral 9 designates a first intermediate plate which is, for example, a brazing sheet with its opposite surfaces coated with a brazing material. The reference numeral 9a designates a first heat exchange fluid communication passage through hole formed in the first intermediate plate continuously in a range including holes communicating with the second fluid outlet and inlet pipes 23 and 24, 9d designates a first through hole which communicates with a first fluid inlet pipe 21, and 9c designates second through holes respectively communicating with the first fluid outlet pipes 22. The reference numeral 10 designates a second end plate which is, for example, an aluminum plate, 11 designates a second intermediate plate which is, for example, a brazing sheet with its opposite surfaces coated with a brazing material, 11*b* designates a fourth through hole which communicates with the second fluid inlet pipe 24, 11*a* designates a third through hole which communicates with the second fluid outlet pipe 23, and 11*d* designates a second heat exchange fluid communication passage through hole formed in the second intermediate plate continuously in a range including the first fluid outlet and inlet pipes 21 and 22. The reference numeral 14 designates a third intermediate plate which is, for example, a brazing sheet with its opposite surfaces coated with a brazing material. The third intermediate plate 14 has a third heat exchange fluid communication passage through hole 14*a* formed therein continuously in a range including the second fluid outlet and inlet pipes 23 and 24 similarly to the first intermediate plate 9. The reference numeral 12 designates a heat exchange plate which is, for example, an aluminum plate, disposed between the first and second intermediate plates 9 and 11 so as to perform heat exchange between the first and second heat exchange fluids A and B. The reference numeral 12*b* designates a fourth through hole communicating with the second fluid inlet pipe 24, 12*a* designates a third through hole communicating with the second fluid outlet pipe 23, 12*d* designates a first through hole communicating with the first fluid inlet pipe 21, and 12*c* designates second through holes communicating with the first fluid inlet pipes 22. The reference numeral 13 designates a heat exchange plate which is, for example, an aluminum plate, disposed between the second and third intermediate plates 11 and 14 so as to perform heat exchange between the first and second heat exchange fluids A and B. The reference numeral 13*b* designates a fourth through hole communicating with the second fluid inlet pipe 24, and 13*a* designates a third through hole communicating with the second fluid outlet pipe 23.

The above-mentioned through holes are worked by using a laser cutter or a turret punching press. For example, when brazing is performed by using anti-corrosion flux, brazing sheets are used as the first, second and third intermediate plates, and flux is spray-applied uniformly onto the surfaces thereof to be joined. Then the first end plate 8, the first intermediate plate 9, the first heat exchange plate 12, the second intermediate plate 11, the second heat exchange plate 13, the third intermediate plate 14, and the second end plate 10 are successively laminated in order; an aluminum brazing material (for example, ring brazing A4045) is set to the junction portions of the first heat exchange fluid inlet pipe 21, the first heat exchange fluid outlet pipes 22, the second heat exchange fluid inlet pipe 23 and the second heat exchange fluid outlet pipe 24; flux is applied to the circumference of the aluminum brazing material. The thus prepared not-yet joined structure is put into a brazing furnace and heated to 600° C. which is a temperature for aluminum brazing so that the structure is integrally fixed by brazing at the same time. Also at this time, similarly to the Embodiment 1, the silver-brazed portion of the outlet and inlet pipes are not melted again about at the aluminum brazing temperature, and no bad influence is given to the brazed portions of the joints.

The operation of such a plate type heat exchanger of a stack of 7 plates as shown in FIG. 3 will be described. The first heat exchange fluid A is led from the first fluid inlet pipe 21 to the second heat exchange fluid communication passage through hole 11*d* through the first through holes 9*d* and 12*d*. Here, the first heat exchange fluid is divided into four flows which reach the first fluid outlet pipes 22 through the second through holes 12*c* and 9*c*. The second heat exchange fluid B is led from the second fluid inlet pipe 24 to the first heat exchange fluid communication passage through hole 9*a* and then led to the third heat exchange fluid communication passage through hole 14*a* through the fourth through holes 12*b*, 11*b* and 13*b*. At this time, the second heat exchange fluid communication passage through hole 11*b* has a passage in opposition to or perpendicularly to the first and third heat exchange fluid communication passage through holes 9*a* and 14*a* so that the first heat exchange fluid A performs heat exchange here from the opposite sides with the first heat exchange fluid A through the heat exchange plates 12 and 13. After heat exchange, the second heat exchange fluid B passes through the fourth through holes 13*a*, 11*a* and 12*a* and then reaches the second heat exchange outlet 23.

Further, each joint is made of a stainless steel material so that electrolytic corrosion hardly occurs because the electric potential between copper and stainless steel is smaller than that between copper and aluminum in the conventional AC joint.

Thus, even in the case of a plate type heat exchanger of a stack of 7 plates or more, the same effects can be obtained by the similar thought if similar joints are used and brazing is performed.

Embodiment 3

Figure 4:
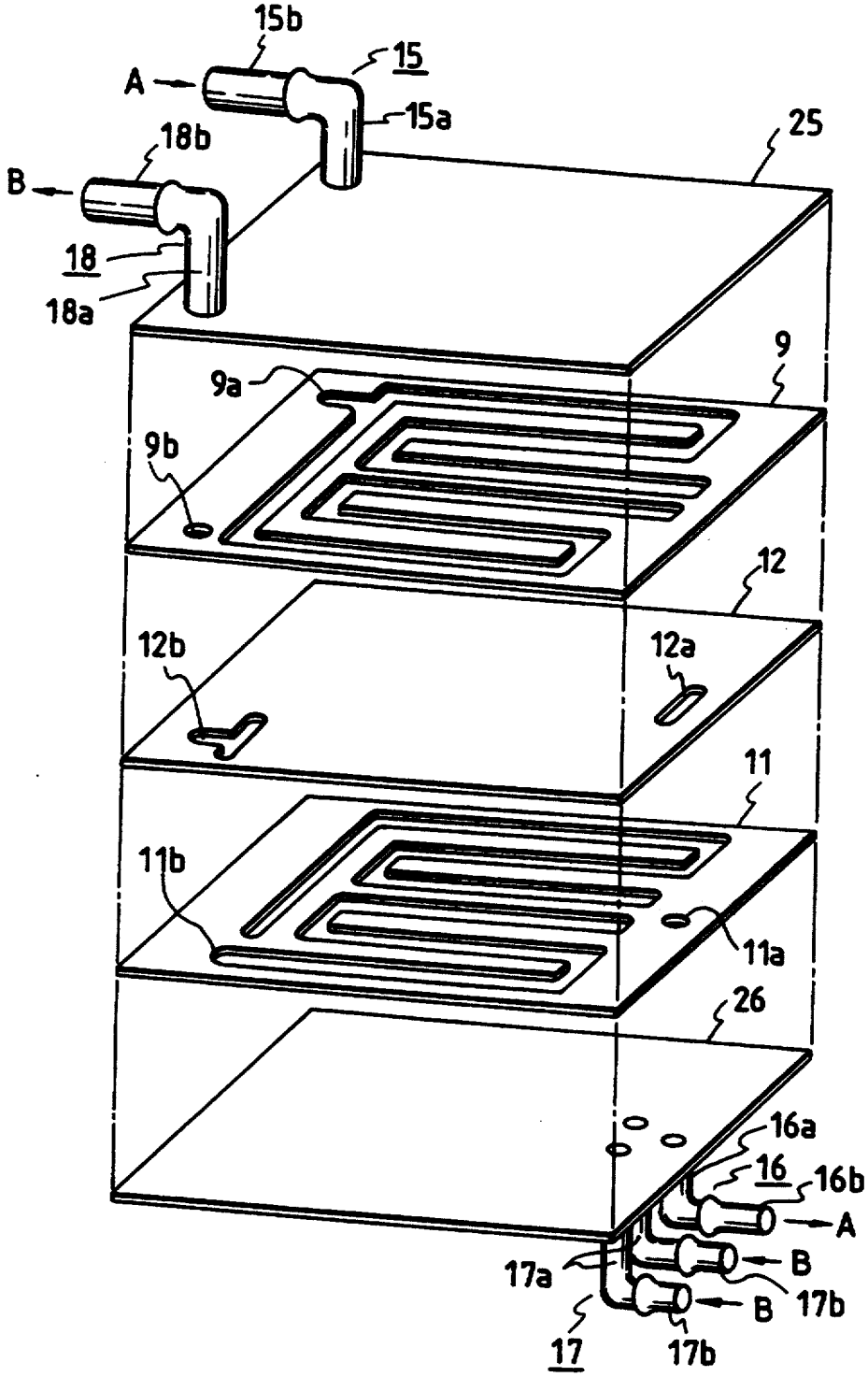
FIG. 4 is an exploded perspective view showing a plate type heat exchanger of a stack of 5 plates according to Embodiment 3 of the present invention.

FIG. 4 is an exploded perspective view of the plate-type heat exchanger of a stack of 5 plates, showing Embodiment 3 of the present invention. In the drawing, the reference numeral 15 designates a fluid inlet pipe for a heat exchange fluid A of high pressure (30 to 45 kgf/cm$^2$) on the condensation side. The fluid inlet pipe 15 is formed in a separate step in advance by joining a pipe 15*a* of a stainless steel material with a pipe 15*b* of a copper material through silver-alloy brazing. Similarly to this, the reference numeral 16 designates a fluid outlet pipe for the heat exchange fluid A of high pressure on the condensation side, the fluid outlet pipe 16 being formed in a separate step in advance by joining a pipe 16*a* of a stainless steel material with a pipe 16*b* of a copper material through silver-alloy brazing. The reference numeral 17 designates fluid inlet pipes for a heat exchange fluid B of low pressure on the evaporation side, each of the fluid inlet pipe 17 being formed in a separate step in advance by joining a pipe 17*a* of a stainless steel material with a pipe 17*b* of a copper material through silver-alloy brazing. Similarly to this, the reference numeral 18 designates a fluid outlet pipe for the heat exchange fluid B of low pressure on the evaporation side, the fluid outlet pipe 18 being formed in a separate step in advance by joining a pipe 18*a* of a stainless steel material with a pipe 18*b* of a copper material through silver-alloy brazing. These joints are brazed by aluminum brazing at their stainless-steel sides to the end plate 25 or 26 made of an aluminum material. The reference numeral 25 designates a first end plate which is a stainless steel plate in this embodiment. The reference numeral 9 designates a first intermediate plate which is, for example, a brazing sheet with its opposite surfaces coated with a brazing material. The reference numeral 9*a* designates a first heat exchange fluid communication passage through hole formed in the first intermediate plate continuously in a range including a first fluid inlet 3, the passage 9*a* being formed so as to meander from the outside to the inside in order to make the heat exchange area wider. The reference numeral 9b designates a first through hole which communicates with a second fluid outlet 6.

The reference numeral 26 designates a second end plate which is a stainless steel plate in this embodiment, 11 designates a second intermediate plate which is, for example, a brazing sheet with its opposite surfaces coated with a brazing material, 11a designates a second through hole which communicates with the second fluid outlet 4, and 11b designates a second heat exchange fluid communication passage through hole formed in the second intermediate plate continuously in a range including a second heat exchange fluid inlet 5, the second heat exchange fluid communication passage through hole 11b being arranged to be in opposition to the first heat exchange fluid communication passage through hole 11a to thereby form a passage.

The reference numeral 12 designates a heat exchange plate which is, for example, an aluminum plate, disposed between the first and second intermediate plates 9 and 11 so as to perform heat exchange between the first and second heat exchange fluids A and B, 12a designates a third through hole formed in the heat exchange plate 12 so as to make the first heat exchange fluid communication passage through hole 9a communicate with the second through hole 11a, and 12b designates a fourth through hole formed so as to make the second heat exchange fluid communication passage through hole 11b communicate with the first through hole 9b.

The above-mentioned through holes are worked by using a laser cutter or a turret punching press. When brazing is performed by using anti-corrosion flux, flux is spray-applied uniformly onto surfaces (opposite surfaces of the intermediate plates 9 and 11) to be joined. Then the first end plate 25, the first intermediate plate 9, the heat exchange plate 12, the second intermediate plate 11, and the second end plate 26 are successively laminated in order; an aluminum brazing material (ring brazing A4045) is set to the junction portions of the first heat exchange fluid inlet pipe 15, the first heat exchange fluid outlet pipe 16, the second heat exchange fluid inlet pipes 17 and the second heat exchange fluid outlet pipe 18; flux is applied to the circumference of the aluminum brazing material. The thus prepared structure is put into a brazing furnace and heated to 600° C. which is a temperature for aluminum brazing so that the structure is integrally fixed by brazing at the same time. At this time, each junction between stainless steel and copper which have been brazed by silver-alloy brazing in advance is not melted again and no bad influence is given to the brazed portions of the junctions because the silver-alloy brazing temperature is 700° C. which is higher than the aluminum brazing temperature. Further, since each joint portion is made of a combination of stainless steel and stainless steel, no electrolytic corrosion is generated in this portion while the withstanding pressure at the joint portion is somewhat lower than that in Embodiment 1. Although electrolytic corrosion occurs between the thick end plates 25, 26 and the intermediate plates 9, 11, the electrolytic corrosion potential between aluminum and stainless steel is comparatively small and the progress of the electrolytic corrosion is slow and there is no fear of damage of the heat exchanger due to such electrolytic corrosion.

Embodiment 4

Figure 5:
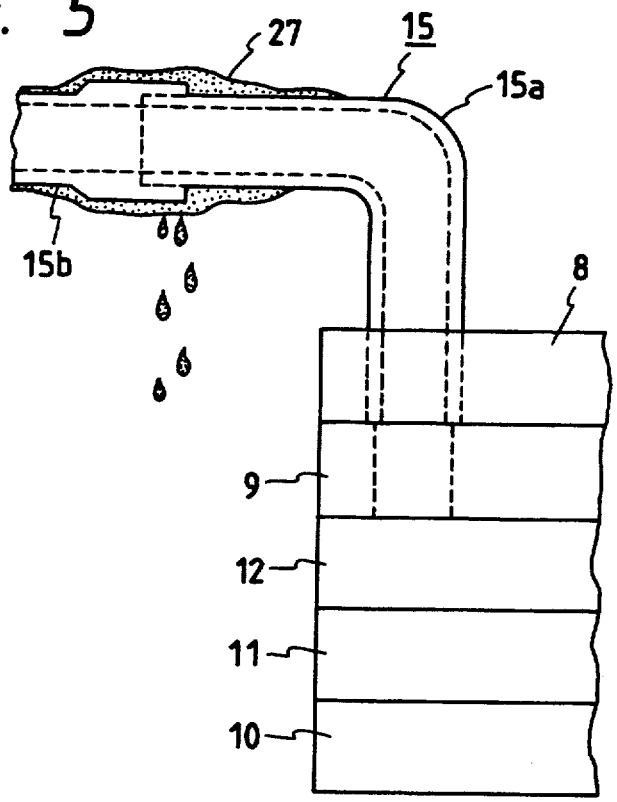
FIG. 5 is a view showing a positional relation of the junction portion between the pipe made of a stainless steel material and a pipe made of a copper material according to Embodiment 4 of the present invention.
Figure 6:
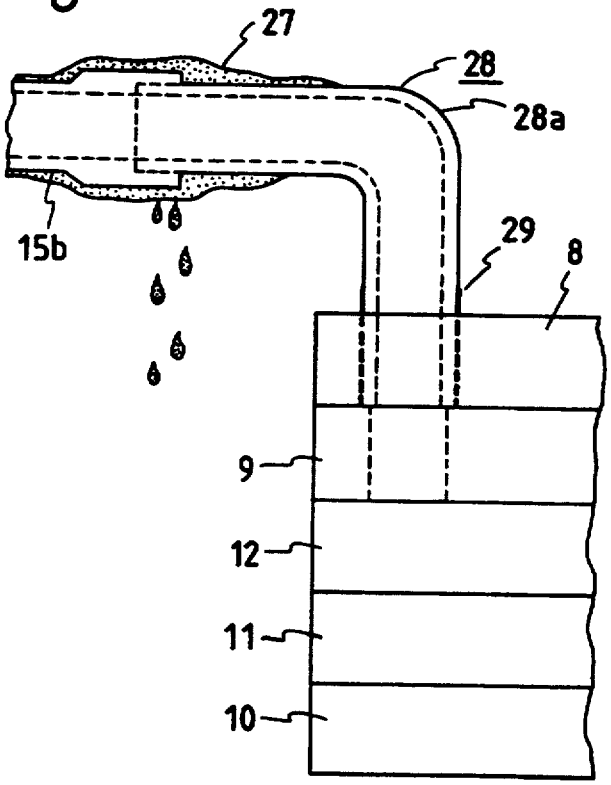
FIG. 6 is a view showing a combination between junction material of the fluid inlet pipe according to Embodiment 5 of the present invention.
Figure 7:
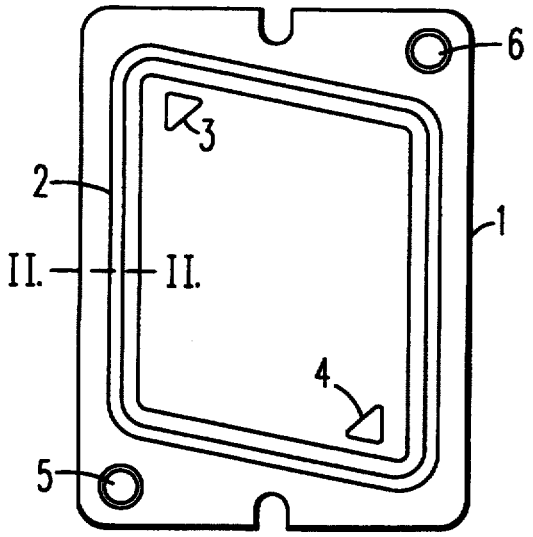
FIG. 7 (PRIOR ART)
FIG. 7 is a front view of plates of a conventional plate type heat exchanger.
Figure 8:
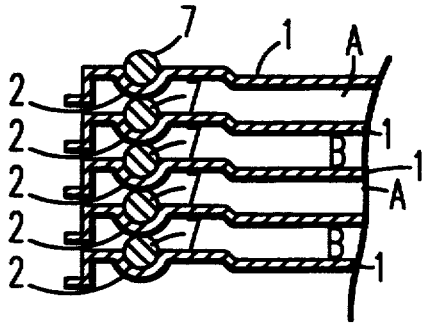
FIG. 8 (PRIOR ART)
FIG. 8 is a partly sectional view of FIG. 7.
Figure 11:
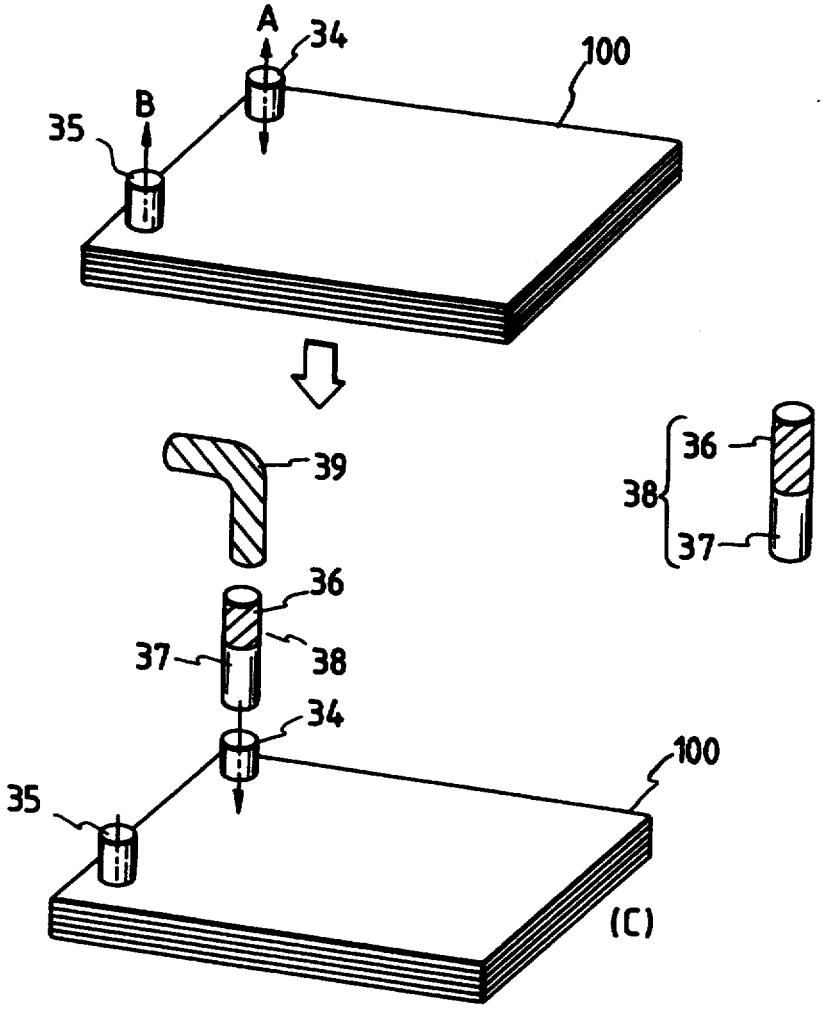
FIG. 11 (PRIOR ART)
FIG. 11 is a view showing a method of manufacturing the conventional plate type heat exchanger including a joint.

Referring to FIG. 5, the positional relation of the joint portion formed of a pipe 15a of a stainless steel material and a pipe 15b of a copper material, which is employed also in the Embodiments 1 to 3, will be described in detail hereunder. In FIG. 5, a fluid inlet pipe 15 for a heat exchange fluid A of high pressure (30 to 45 kgf/cm$^2$) on the condensation side is circumferentially partially enlarged. Similarly to the Embodiments 1 to 3, the heat exchanger portion is constituted by a first end plate 8, a first intermediate plate 9, a heat exchange plate 12, a second intermediate plate 11 and a second end plate 10. A pipe 15a of a stainless steel material is bent so that the position of the joint portion of a pipe 15b of a copper material comes to the outside of the heat exchanger body as shown in FIG. 5.

Next, the effect of the positional relation of this joint portion of this pipe will be described. When the heat exchange fluid A passes, the air around the fluid inlet pipe 15 is condensed so that water drops 27 adhere onto the pipe. When the condensed water drops 27 touch the copper pipe 15b, copper dissolves as copper ions into the condensed water 27. Water containing copper ions is apt to give damage due to corrosion to aluminum. If the water drops containing copper ions fall onto the first end plate 8, accumulate there, evaporate there, and then the water drops containing copper ions fall onto the same place, the concentration of copper ions becomes higher and higher so that damage is given to the heat exchanger. In this embodiment, however, there is no such fear because the junction portion of the joint is placed in a position where the condensed water 27 in which copper is dissolved as copper ions never drops down. On the other hand, though the condensed water 27 attaches onto the joint portion, the water 27 falls immediately as water drops and the concentration of copper ions does not become higher. Further, since the stainless pipe 15a is bent, the condensed water 27 in which copper is dissolved as copper ions hardly flows out into the heat exchanger along the fluid inlet pipe 15. Thus, the electrolytic corrosion on the heat exchanger body is prevented by controlling the junction portion of the joint (the position of the copper pipe).

Embodiment 5

Although a pipe structure constituted by a pipe of a stainless steel material and a pipe of a copper material jointed by silver-alloy brazing with each other is used as each of the fluid inlet and outlet pipes in the above Embodiments 1 to 4, electrolytic corrosion can be prevented in the case of using a pipe 28a made of an insulation material such as ceramics. In this case, it is necessary to apply metallizing treatment 29 such as Ni plating on the ceramics side to improve the property of joining by aluminum brazing between the pipe 28a and the end plate 8.

As described above, according to the present invention, end plates having first and second fluid inlets and outlets, intermediate plates having through holes and fluid communication passage through holes, and one or more heat exchange plates each interposed between the intermediate plates for performing heat exchange between the first and second fluids are stacked on one another so as to be integrated with each other. Accordingly, the invention has effects that it is possible to obtain a plate type heat exchanger in which the structure is so simple that the through holes may be worked by using a laser cutter or a turret punching press without requiring any metal molds for exclusive use, and the degree of freedom is large, and in which the respective plates are stacked strongly by brazing with brazing sheets or by an adhesive agent so that the seal strength is large.

Since joints each constituted by a copper pipe and a stainless steel pipe joined in advance with each other by brazing at a temperature higher than aluminum brazing or by welding suitably arranged so that those joints may be joined at their stainless steel pipe sides with the end plates, and those joints are aluminum brazed at the same time when the plate type heat exchanger is aluminum brazed, there is no fear of occurrence of electrolytic corrosion even when the heat exchanger connected to the outside of the plate type heat exchanger has copper piping and it is possible to prevent damage from being given to the brazed portions of the plate type heat exchanger or defects from being generated in the junction portions.

What is claimed is:

1. A plate-type head exchanger comprising:

(I) a first end plate body having a first fluid inlet and a second fluid outlet;

(II) a first intermediate plate body having a first fluid communication passage through-hole formed to communicate with said first fluid inlet so as to constitute said first fluid communication passage, and (b) a first through-hole formed to communicate with said second fluid outlet;

(III) a second end plate body having a first fluid outlet and a second fluid inlet;

(IV) a second intermediate plate body having (a) a second through-hole formed to communicate with said first fluid outlet, and (b) a second fluid communication passage through-hole formed to communicate with said second fluid inlet so as to constitute said second fluid communication passage;

(V) a heat exchange plate body having (a) a third through-hole formed to communicate with said first fluid communication passage through-hole and said second through-hole, and (b) a fourth through-hole formed to communicate with said, second fluid communication passage through-hole and said first through-hole, (VI) a plurality of joint pipe structures each of which is attached to said first fluid inlet and second fluid outlet of said first end plate body, and to said first fluid outlet and said second fluid inlet of said second end plate body, each of said joint pipe structures comprising an intermediate pipe made of a stainless steel material attached to said respective first and second fluid inlets and first and second fluid outlets, and an end pipe made of copper material and attached to said intermediate pipe, said heat exchange plate body being interposed between said first and second intermediate plate bodies so as to perform heat exchange between said first and second fluids; and said first and second end plate bodies, said first and second intermediate plate bodies, and said heat exchange plate body being stacked on one another so as to be integrated with each other and the joint pipe structures at the same time by brazing.

2. In a piping joint structure of a plate-type heat exchanger which connects an indoor machine of an air conditioner having a copper piping with a plate-type heat exchanger comprising a first end plate body having a first fluid inlet and a second fluid outlet, a first intermediate plate body having a first fluid communication passage through-hole formed to communicate with said first fluid inlet so as to constitute said first fluid communication passage and a first through-hole formed to communicate with said second fluid outlet, a second end plate body having a first fluid outlet and a second fluid inlet, a second intermediate plate body having a second through-hole formed to communicate with said first fluid outlet and a second fluid communication passage through-hole formed to communicate with said second fluid inlet so as to constitute said second fluid communication passage, a heat exchange plate body having a third through-hole formed to communicate with said first fluid communication passage through-hole and said second through-hole and a fourth through-hole formed to communicate with said second fluid communication passage through-hole and said first through-hole, said heat exchange plate body being interposed between said first and second intermediate plate bodies so as to perform heat exchange between said first and second fluids, said first and second end plate bodies, said first and second intermediate plate bodies, and said heat exchange plate body being stacked on one another so as to be integrated with each other, wherein an intermediate pipe is joined to the copper piping at one end, said intermediate pipe being made of a metallic material having a value of polarization potential which becomes lower than that generated between a material of the heat exchanger body and a material of the copper piping, a second end of said intermediate pipe being directly joined said heat exchanger body so that a maximum electrolytic corrosion side of the copper piping does not contact said heat exchanger body.

3. A piping joint structure as claimed in claim 2, wherein said intermediate pipe is bent so that a junction portion between the copper piping and the intermediate pipe is disposed outside of and spaced from the heat exchanger body, such that if open air produces dew at said junction portion, water of the dew does not flow down into a body of said heat exchanger.

* * * * *